US011384720B2

(12) United States Patent
Hartwig et al.

(10) Patent No.: US 11,384,720 B2
(45) Date of Patent: Jul. 12, 2022

(54) DISTRIBUTION DEVICE FOR DISTRIBUTING FLUID FLOWS AND METHOD FOR OPERATING A MOTOR VEHICLE HAVING AN INTERNAL COMBUSTION ENGINE

(71) Applicant: Volkswagen Aktiengesellshaft, Wolfsburg (DE)

(72) Inventors: Gerson Hartwig, Wolfsburg (DE); Dirk Franke, Jembke (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 17/459,473

(22) Filed: Aug. 27, 2021

(65) Prior Publication Data

US 2022/0065205 A1 Mar. 3, 2022

(30) Foreign Application Priority Data

Aug. 27, 2020 (DE) ..... 10 2020 210 855.2

(51) Int. Cl.

| | |
|---|---|
| ***F01M 1/08*** | (2006.01) |
| ***F01M 9/10*** | (2006.01) |
| ***F02M 41/12*** | (2006.01) |
| ***F02M 41/14*** | (2006.01) |

(52) U.S. Cl.

CPC ..... *F02M 41/123* (2013.01); *F01M 1/08* (2013.01); *F01M 9/109* (2013.01); *F02M 41/1422* (2013.01); *F02M 41/1427* (2013.01)

(58) Field of Classification Search

CPC ..... F02M 41/123; F02M 1/1422; F02M 41/1427; F01M 1/08; F01M 2001/083; F01M 2001/086; F01M 1/16; F01M 9/105; F01M 9/109

See application file for complete search history.

(56) References Cited

U.S. PATENT DOCUMENTS

| | | | | |
|---|---|---|---|---|
| 4,801,339 | A * | 1/1989 | Osborn | C22F 1/04 75/235 |
| 7,984,670 | B2 | 7/2011 | Sequera et al. | |
| 8,707,927 | B2 | 4/2014 | Hazelton | |
| 8,746,193 | B2 | 6/2014 | Bowler et al. | |
| 2013/0179049 | A1 | 7/2013 | Grieser et al. | |

(Continued)

FOREIGN PATENT DOCUMENTS

| | | | |
|---|---|---|---|
| CN | 203515760 | U | 4/2014 |
| CN | 205297712 | U | 6/2016 |
| CN | 106285904 | A | 1/2017 |

(Continued)

*Primary Examiner* — Jacob M Amick

(74) *Attorney, Agent, or Firm* — Muncy, Geissler, Olds & Lowe, P.C.

(57) ABSTRACT

A distribution device for distributing fluid flows, having a main passage and having a multiplicity of discharge passages branching off from the main passage, wherein the distribution device is designed to distribute a fluid flow entering the main passage among the discharge passages. An inner passage is arranged inside the main passage, wherein the inner passage is designed to conduct fluid that enters the inner passage to at least one of the discharge passages, and wherein the distribution device has a shutoff device for shutting off a fluid flow entering the inner passage from the main passage.

10 Claims, 2 Drawing Sheets

(56) References Cited

U.S. PATENT DOCUMENTS

2020/0139314 A1* 5/2020 Langstrand ..... C23C 14/228

FOREIGN PATENT DOCUMENTS

| | | | | | |
|---|---|---|---|---|---|
| CN | 106812564 | A | | 6/2017 | |
| CN | 109676338 | A | | 4/2019 | |
| DE | 266055 | C | | 10/1913 | |
| DE | 3705817 | A1 | | 9/1988 | |
| DE | 19927467 | A1 | * | 12/2000 | ..... F02F 1/24 |
| DE | 19927467 | A1 | | 12/2000 | |
| DE | 102012212597 | A1 | | 1/2013 | |
| DE | 102013201390 | A1 | | 8/2013 | |
| DE | 102017112565 | A1 | | 12/2017 | |
| EP | 1995472 | A1 | | 11/2008 | |
| FR | 2980519 | A1 | | 3/2013 | |
| FR | 3023319 | A1 | | 1/2016 | |
| KR | 1020110062408 | | | 6/2011 | |

* cited by examiner

DISTRIBUTION DEVICE FOR DISTRIBUTING FLUID FLOWS AND METHOD FOR OPERATING A MOTOR VEHICLE HAVING AN INTERNAL COMBUSTION ENGINE

This nonprovisional application claims priority under 35 U.S.C. § 119(a) to German Patent Application No. 10 2020 210 855.2, which was filed in Germany on Aug. 27, 2020, and which is herein incorporated by reference.

BACKGROUND OF THE INVENTION

Field of the Invention

The present invention relates to a distribution device for distributing fluid flows as well as to a method for operating a motor vehicle having an internal combustion engine.

Description of the Background Art

Piston cooling systems are used in modern internal combustion engines. Such a piston cooling system can be realized in that a fluid is used to cool the piston, for example. The fluid can be a lubricating oil, for example. The fluid can be applied to the pistons by so-called piston cooling nozzles.

It is known from the prior art that such piston cooling nozzles can be shut down, for example in order to deactivate the piston cooling system under certain operating states in which no piston cooling is needed. This can be accomplished by pressure-controlled valves integrated into the piston cooling nozzles, for example. If the valves are acted on by a pressure that exceeds a certain limit pressure, then the valves open.

Alternatively, distribution devices for distributing fluid flows are known from the prior art in which a fluid flow entering a main passage is distributed over a multiplicity of discharge passages branching off from the main passage. For example, a distribution device is known from FR 3 023 319 A1 in which the fluid flows entering the discharge passages from the main passage can be shut off by a shutoff device. The shutoff in this case is accomplished in such a manner that the discharge passages branching off from the main passage are shut off simultaneously by the movement of a shutoff element of the shutoff device.

In addition, a shutoff device is known from KR 10 2011 006 2408 A that makes it possible to permit different rates of flow through the selective shutoff or opening of two discharge passages branching off from a main passage which come back together again after they branch off of the main passage.

According to the prior art, however, with such piston cooling systems there is the problem that a worsening of the emission values occurs in internal combustion engines with cylinder shutdown systems. In particular, increased particulate matter formation can be observed when cylinders that were previously shut down are reactivated and thus are fired.

SUMMARY OF THE INVENTION

It is therefore an object of the present invention to provide a distribution device for distributing fluid flows and a method for operating an internal combustion engine in which the above-described problems do not occur at all or at least occur to a reduced extent.

A distribution device for distributing fluid flows according to an exemplary embodiment the invention has a main passage and a multiplicity of discharge passages branching off from the main passage. Here, the distribution device is designed to distribute a fluid flow entering the main passage among the discharge passages. The fluid can be, in particular, a lubricant and/or a coolant, for example a lubricating oil that performs a cooling function in addition to its lubricating function.

According to the invention, an inner passage is arranged inside the main passage. The inner passage is designed to conduct fluid that enters the inner passage to at least one of the discharge passages. The shutdown device has a shutoff device for shutting off a fluid flow entering the inner passage from the main passage.

This arrangement makes it possible to shut off in a targeted manner the fluid flow to the at least one discharge passage to which the fluid entering the inner passage is conducted. Other discharge passages branching off from the main passage are not affected by the shutoff of the fluid flow, which is to say the fluid flow entering the main passage continues to be distributed among these discharge passages. Only those discharge passages that are being supplied with fluid through the inner passage are shut off by the shutoff device. It is advantageous in this context when the discharge passages to which the fluid entering the inner passage is conducted can be reached solely through the inner passage by the fluid entering the main passage.

In this case the distribution device can be configured such that the fluid flow entering the inner passage from the main passage first flows around the inner passage when passing through the main passage. Such an implementation, in which the inner passage is positioned inside the fluid flow in the main passage, offers, in particular, the advantage that existing design concepts can be complemented by the inner passage and by the targeted shutoff of at least one discharge passage branching off from the main passage that is allowed thereby. The flow around the inner passage makes it possible for the discharge passages branching off from the main passage that are not supplied with fluid through the inner passage to continue to be reachable by the fluid flow.

Accordingly, the method according to the invention for operating an internal combustion engine provides that a fluid flow conducted to a piston to be cooled is interrupted by means of a shutoff device when the cylinder to which this piston belongs is not being fired on account of a cylinder shutdown while at least the piston of another cylinder that is being fired continues to be cooled by means of a fluid flow branching off of the interrupted fluid flow.

The idea of shutting off the fluid flow that is conducted to a cylinder for cooling the piston of this cylinder in the event of shutdown of the cylinder, and thus stopping the piston cooling of the shut-down cylinder, is based on the realization that the unfavorable particulate emission values that have been observed in connection with the cylinder shutdown can be eliminated and/or at least reduced by this means. The concept is based on the realization that when a cylinder is shut down, the piston cooling of the shut-down cylinder causes the ring gap and ring land cross-sections to deform on account of the absent combustion temperature in a manner that causes increased oil transport into the combustion chamber to occur. In addition, the pressure in the combustion chamber drops on account of the absent combustion, which likewise fosters oil transport from the crankcase into the combustion chamber. The consequences are elevated particulate emissions when the cylinder that has been shut down is placed in operation again. This adverse effect can be counteracted—at least to a certain degree—by shutting down the piston cooling of the shut-down cylinder.

It is a matter of course that shutting down the piston cooling of at least one cylinder can be achieved by means of the described distribution device, in particular. This device can be easily integrated into existing design concepts, in particular, so that carrying out the method for operating an internal combustion engine can be made possible in an advantageous fashion. However, it is fundamentally also possible to permit a selective shutdown of piston cooling of individual cylinders as a function of their cylinder shutdown by means of other technical devices.

It is likewise possible to use the described distribution device to selectively shut off other fluid flows than those used for piston cooling. The distribution device here is, in particular, part of a motor vehicle, however. The fluid flows conducted to the individual discharge passages can be used to supply transmissions with a fluid, for example. In this context, the shutoff function can be used, in particular, to supply these transmissions with the fluid as a function of specific driving conditions. This is especially advantageous when a hybrid vehicle or a vehicle with a hybrid drive is involved. In such vehicles, parts of the drive train, in particular transmissions, are not used at times, in particular when the motor vehicle is temporarily operated solely electrically or solely with the internal combustion engine. In these cases, it is possible with the distribution device to cool parts of the drive train, in particular individual transmissions, selectively as a function of the operating state, depending on the corresponding operating state.

It is possible that the inner passage is formed by a tube. The inner passage can, in particular, be pressed into the main passage. In this context, an economical possibility is produced for implementing the inner passage arranged inside the main passage. The tube that forms the inner passage can in this case have branches that end at the branching discharge passages that are to be supplied with the fluid through the inner passage when the inner passage is located in its prescribed position in the main passage. In addition, the inner passage can have spacer elements. These can be separate components; alternatively and/or in addition, the spacer elements can be integrally molded on the component that forms the inner passage, for example a tube. The spacer elements make it possible to press into the main passage a tube whose outer diameter is smaller than the diameter of the main passage. This makes it possible that the fluid located in the main passage can flow around the inner passage.

The main passage can be formed by a cast component. Casting processes permit the economical reproduction of components with comparatively complicated geometries. The passages can have been produced as early as the casting process itself in this case, alternatively and/or in addition it is possible for the passages to be made in the component later, for example in the form of drilled holes. The advantage of the described distribution device is that, in contrast to comparable distribution devices that can be shut down according to the prior art, in which the shutoff device is contained in the main passage, there are no high requirements on the processing of the material surfaces that delimit the main passage. Particularly with the embodiment of the inner passage as a pressed-in tube, it is possible to press the latter into an unmachined or nearly unmachined cast part, for example.

The shutoff device can be inserted into the main passage. Owing to the insertion into the main passage, the shutoff device can be installed in a simple manner. It is possible in this case that the shutoff device is pushed onto the component that forms the inner passage. Very simple installation on the whole results in this way. Especially when the component that forms the inner passage is a pressed-in tube, installation of the distribution device can be accomplished in a simple manner in that the tube is first pressed into the main passage and then the shutoff device is simultaneously inserted into the main passage and pushed onto the tube.

The shutoff device can have a housing that is arranged inside the main passage and through which the fluid flow entering the inner passage from the main passage initially travels when coming from the main passage before the fluid flow enters the inner passage. In other words, the fluid flow travels from the main passage through the housing of the shutoff device into the inner passage. This enclosure of the shutoff device in its own housing allows, in particular, for easy handling thereof, for example during installation, especially in the case of installation by insertion into the main passage as in the above description.

The shutoff device can have a shutoff element for shutting off the fluid flow entering the inner passage from the main passage, which element moves parallel to the main direction of extent of the main passage in order to shut off the fluid flow. Such a design makes it possible to implement the shutoff device in an elongated construction so that the shutoff device can be arranged inside the main passage.

The shutoff device can be configured such that the shutoff element is subjected to mutually opposing forces acting in both directions of motion of the shutoff element due to the pressure of the fluid. In this way it is possible, in particular, to design the shutoff device to be pressure compensated. In other words, this means that the operating forces are, in particular, independent of the pressure of the fluid and of the position of the shutoff element along its direction of motion.

The shutoff device can be a solenoid valve, in particular. A solenoid valve offers the advantage that it can be actuated in a simple and direct manner by a control device on account of its direct electrical operation. In this way it is possible that a control device that causes a cylinder shutdown, for example, simultaneously causes the shutdown of the piston of the shut-down cylinder or of the pistons of the shut-down cylinder. In comparison to pressure-controlled valves, solenoid valves additionally have the advantage that the operating state of the valve is independent of the pressure of the fluid. In this way it is possible, for example, to achieve load conditions of an internal combustion engine that are accompanied by higher oil pressures without this automatically causing operation of the shutoff device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
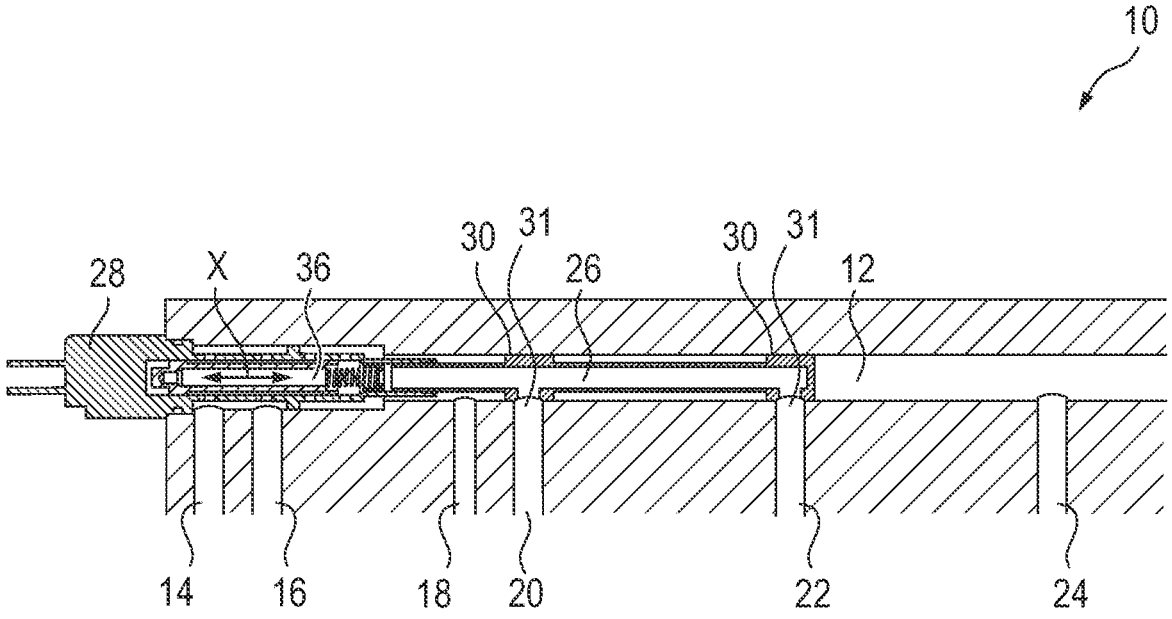
FIG. 1 is a sectional view of an exemplary distribution device.

The distribution device 10 shown by way of example in the figures has a main passage 12. This passage can have a circular cross-section, as shown, and extend along a main direction of extent X. The distribution device 10 additionally has a multiplicity of discharge passages branching off from the main passage 12. In the example shown, these are the discharge passages 14, 16, 18, 20, 22, and 24. The distribution device 10 can be an oil gallery of an engine block, for example. The discharge passages 14, 16, 18, 20, 22, 24 depicted in the example shown can, in particular, be associated with different elements of an internal combustion engine to be lubricated and/or to be cooled and can supply these elements with the fluid, which can be an oil, for example. Thus, for example, the discharge passage 14 can supply the cylinder head, the discharge passage 18 can supply a bearing, while the individual discharge passages 16, 20, 22, and 24 are associated with individual piston cooling nozzles for cooling the pistons of the cylinders of the engine. For example, each of the discharge passages 16, 20, 22, and 24 can be associated with one piston of a cylinder of a four-cylinder engine.

In the example shown, an inner passage 26 is arranged inside the main passage 12. This inner passage 26 is designed to conduct fluid entering the inner passage 26 to at least one of the discharge passages, for example to the discharge passages 20 and 22 as shown. The distribution device 10 additionally has a shutoff device 28 for shutting off a fluid flow entering the inner passage 26 from the main passage 12.

The distribution device 10 in this case can, as in the example shown, be configured such that the fluid flow entering the inner passage 26 from the main passage 12 first flows around the inner passage 26 when passing through the main passage 12. This can be made possible, as in the example shown, by the means that the inner passage 26 is formed by a tube whose outer dimensions, or rather whose outer diameter, is smaller than the dimensions of the main passage 12, in particular the diameter thereof. The arrangement of the inner passage 26 spaced apart from the wall of the main passage 12 can be made possible, as in the example shown, in that an attachment of the inner passage 26 in the main passage 12 is accomplished with suitable spacer elements 30. The embodiment represented in the figures shows an inner passage 26 that can be pressed into the main passage 12 in a simple manner. The inner passage 26 can have branches 31 in this design. In this case, the inner passage 26 can be positioned in the main passage 12 such that the branches 31 are positioned at locations where the discharge passages that are to be shut off by the shutoff device 28 branch off from the main passage 12. In the example shown, these are the discharge passages 20 and 22.

As in the example shown, the shutoff device 28 can be inserted into the main passage 12. In this case, the shutoff device 28 can be arranged at least partially inside the main passage 12, as in the example shown. This makes it possible for the fluid that enters the inner passage 26 from the main passage 12 to first enter a housing 32 of the shutoff device 28. For this purpose, the housing 32 can have openings 34 that permit the fluid to enter the housing 32.

Figure 2:
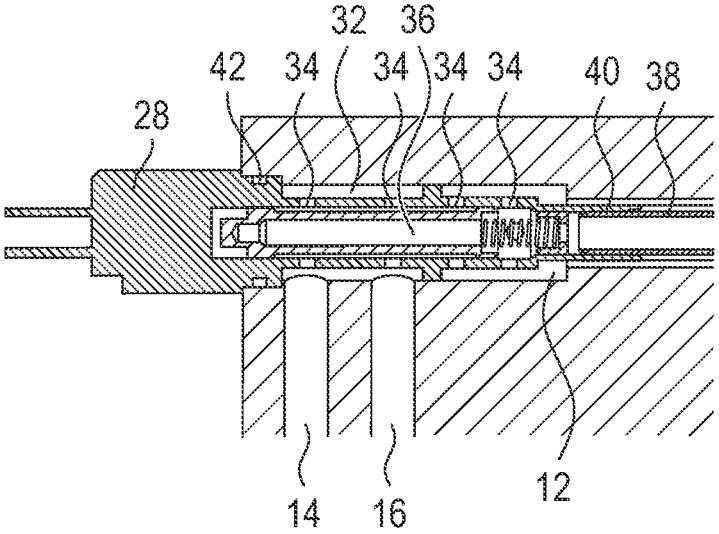
FIG. 2 is an enlarged sectional view of the shutoff device of the exemplary distribution device from FIG. 1 in the open state.
Figure 3:
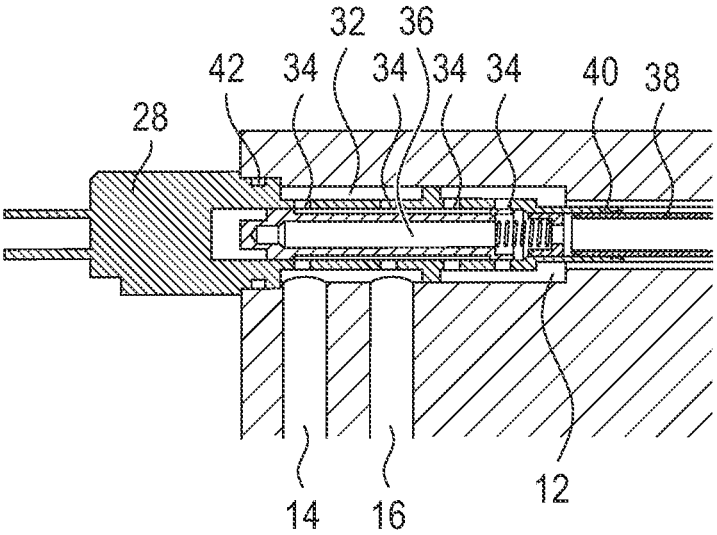
FIG. 3 is a view corresponding to FIG. 2 of the shutoff device in the closed state.

The shutoff device 28 can have a shutoff element 36, as is shown by way of example. As depicted in the figures, the shutoff element 36 can move along the direction X in order to shut off the fluid flow that reaches the inner passage 26 coming from the main passage 12 through the housing 32 of the shutoff device 28. This process is depicted in FIGS. 2 and 3. In FIG. 2, the fluid can flow through the openings 34 as far as the inner passage 26. In FIG. 3, the flow path is interrupted by the shutoff element 36.

The shutoff device 28 can be pushed onto the inner passage 26, as in the example shown. For this purpose, shutoff device 28 and/or inner passage 26 can have suitable end regions 38, 40. These regions can, as shown, have lead-in bevels, for example, in order to facilitate a mating of shutoff device 28 and inner passage 26.

When the distribution device 10 is used in a method described above for operating an internal combustion engine, for example, it can have the advantageous effect that a perfect seal need not be present between the shutoff device 28 and the inner passage 26 or between the branches 31 and the wall of the main passage 12. It is sufficient when the bulk of the fluid flow that is to be shut off is interrupted; in such a use, minimal leakage at the sealing points will not result in a cooling action that would negate the effect of the shutoff of the fluid flow with regard to piston cooling.

Accordingly, the shutoff device 28 can have a seal for the main passage 12. This is implemented by an O-ring 42 in the example shown. In this way, a simple seal can be achieved between the shutoff device 28 and the inner passage 26. The shutoff device 28 can be attached at its prescribed position with, for example, a removable fastener such as a screw. In this way, the shutoff device 28 can easily be removed and installed, for example for repair and/or maintenance purposes.

The features of the invention disclosed in the present description, in the drawings, and in the claims can be essential, both individually and in any combinations, for implementing the invention in its various embodiments. The invention can be varied within the scope of the claims and taking into account the knowledge of the relevant person skilled in the art.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A distribution device for distributing fluid flows, the distribution device comprising:

a main passage;

at least two discharge passages branching off from the main passage, the distribution device being designed to distribute a fluid flow entering the main passage among the at least two discharge passages;

an inner passage arranged inside the main passage, the inner passage adapted to conduct fluid that enters the inner passage to at least one of the at least two discharge passages; and a shutoff device to shut off a fluid flow entering the inner passage from the main passage.

2. The distribution device according to claim 1, wherein the distribution device is configured such that the fluid flow entering the inner passage from the main passage first flows around the inner passage when passing through the main passage.

3. The distribution device according to claim 1, wherein the inner passage is formed by a tube pressed into the main passage.

4. The distribution device according to claim 1, wherein the main passage is formed by a cast component.

5. The distribution device according to claim 1, wherein the shutoff device is inserted into the main passage, or wherein the shutoff device is pushed onto a pressed-in tube.

6. The distribution device according to claim 1, wherein the shutoff device has a housing that is arranged inside the main passage and through which the fluid flow entering the inner passage from the main passage initially travels when coming from the main passage before the fluid flow enters the inner passage.

7. The distribution device according to claim 1, wherein the shutoff device has a shutoff element for shutting off the fluid flow entering the inner passage from the main passage, which element moves parallel to the main direction of extent of the main passage in order to shut off the fluid flow.

8. The distribution device according to claim 1, wherein the shutoff device is configured such that the shutoff element is subjected to mutually opposing forces acting in both directions of motion of the shutoff element due to the pressure of the fluid.

9. The distribution device according to claim 1, wherein the shutoff device is a solenoid valve.

10. A method for operating an internal combustion engine, the method comprising:

operating the internal combustion engine via a distribution device according to claim 1; and interrupting a fluid flow conducted to a piston to be cooled via the shutoff device when the cylinder to which this piston belongs is not being fired on account of a cylinder shutdown while at least one of the pistons of another cylinder that is being fired continues to be cooled via a fluid flow branching off of the interrupted fluid flow.

* * * * *